United States Patent [19]

Biondetti

[11] 4,061,532

[45] Dec. 6, 1977

[54] ADJUSTABLE SUCTION DEVICE FOR A PAPER MACHINE

[75] Inventor: Mario Biondetti, Schio, Italy

[73] Assignee: Escher Wyss GmbH, Weingarten, Germany

[21] Appl. No.: 718,514

[22] Filed: Aug. 30, 1976

[30] Foreign Application Priority Data

Sept. 2, 1975 Switzerland ..... 11360/75

[51] Int. Cl.[2] ..... D21F 1/54

[52] U.S. Cl. ..... 162/352; 162/374

[58] Field of Search ..... 162/352, 354, 363, 374, 162/272

[56] References Cited

U.S. PATENT DOCUMENTS

| | | | |
|---|---|---|---|
| 3,323,982 | 6/1967 | Hill | 162/352 |
| 3,377,236 | 4/1968 | Roecker | 162/352 X |
| 3,711,368 | 1/1973 | Truxa | 162/354 |

FOREIGN PATENT DOCUMENTS

| | | | |
|---|---|---|---|
| 901,067 | 7/1962 | United Kingdom | 162/352 |

*Primary Examiner*—Richard V. Fisher

*Attorney, Agent, or Firm*—Kenyon & Kenyon, Reilly, Carr & Chapin

[57] ABSTRACT

The suction strip is mounted via a tube carrier on a pair of supports so as to pivot about an axis extending longitudinally of the carrier. The pivot axis is located in a vertical plane which passes through the front tip of the suction strip. Pivoting is effected via a leaf spring which mounts the carrier on the supports and at least one adjusting screw. The adjusting screw may have different thread pitches at opposite ends to obtain a coarse and fine control.

11 Claims, 3 Drawing Figures

ADJUSTABLE SUCTION DEVICE FOR A PAPER MACHINE

This invention relates to a suction device for a paper machine.

As is known, paper machines frequently employ suction strips which cooperate with a wire of the machine to drain off water and which are adjustable to different angles. One such suction strip is described in U.S. Pat. No. 2,928,465, FIG. 2. In this known device, a part provided with the suction surface is rockable about a hinge pin which extends over the entire width of the paper machine wire from which water is to be drained off from a paper fleece forming on the wire. However, this known device is relatively expensive and is not very rigid. Further, the device is not sufficiently reliable in operation, because the hinged connection with the pin can readily jam due to rust or dirt.

Other suction devices are also known, such as described in Swiss Pat. No. 545,375, in which a part provided with the suction surface is interchangeably fixed on a member extending transversely over the entire width of the paper machine. If it is necessary to change the angle of the suction surface, the part can be changed for another. Of course, this form of construction is not suitable for frequent and rapid changes of the angle of the suction surface.

Accordingly, it is an object of the invention to provide a suction device which is continuously adjustable in a simple manner during operation so that the angle of the suction surface can be changed while the suction strip is kept very rigid in the position to which the device has been set.

It is another object of the invention to provide a simple mounting for an adjustable suction strip for draining water from a wire of a paper machine.

It is another object of the invention to provide an adjustable suction device with parts which are insensitive to rust.

Briefly, the invention provides a suction device for a paper machine which comprises a suction strip, a carrier having the suction strip rigidly fixed thereon and a pair of supports. The suction strip, as is known, has a suction surface for cooperating with a wire of the machine and a front tip while the carrier is disposed transversely of the wire. The two supports pivotally support the carrier about a common pivot axis which extends longitudinally of the carrier and is located in a plane extending through the front tip of the suction strip perpendicularly of the wire. Each support is also disposed at a respective end of the carrier.

In this way it is possible to make the carrier rigid, and particularly rotationally stiff. The rotatable mounting is limited only at the ends and, thus, simplifies the suction device.

The carrier may be provided with an adjustment means at least at one end to allow a pivoting adjustment of the carrier about the pivot axis of the supports. With a sufficiently rigid carrier construction, the adjustment means may be provided at just one end of the carrier, e.g. on the control side of the machine. This greatly simplifies the machine operation and also avoids the risk of the suction strip being twisted due to different adjustments at the two ends of the carrier as well as breaking if the carrier is made of a hard brittle material.

Each support may comprise a part in the form of a leaf spring rigidly fixed on a housing adapted for fixing to the paper machine and a part disposed on the carrier. The leaf spring is vertically disposed in the vertical plane extending through the tip of the suction strip. This not only provides a rockable mounting insensitive to rust and dirt but, in addition, a very rigid support for the suction strip vertically, i.e. perpendicularly to the wire plane, thus avoiding vibration of the strip and wire.

The adjustment means may comprise an adjustment screw having two screwthreaded portions with different pitches, one of the screwthreaded portions being screwed in the housing and having an axis disposed substantially parallel to the leaf spring while the other screwthreaded portion is screwed into a pin mounted rotatably in the part disposed at the end of the carrier. The adjustment screw allows fine adjustment of the suction strip angle and simultaneously supports the carrier with the suction strip in the direction in which the leaf spring is particularly soft, i.e. the direction parallel to the wire plane.

The leaf spring may be adjustable in the vertical plane for adjustment of the height of the front tip of the suction strip. Preferably, the bottom end of the leaf spring may be supported on an adjusting screw screwed into the housing. The leaf spring may also consist of a glass fiber reinforced plastic. Apart from the fact that such a part is insensitive to rust, the part may be made thicker than, for example, a steel leaf spring for a given flexural stiffness. The stiffness of the spring perpendicularly to its plane, i.e. in the direction of the wire, is thus increased.

The carrier may preferably consist of a tube. In this way, optimum stiffness parallel to the direction of the wire and perpendicularly thereto is obtained at low cost.

These and other objects and advantages will become more apparent from the following detailed description taken in conjunction with the accompanying drawings in which.

Figure 1:
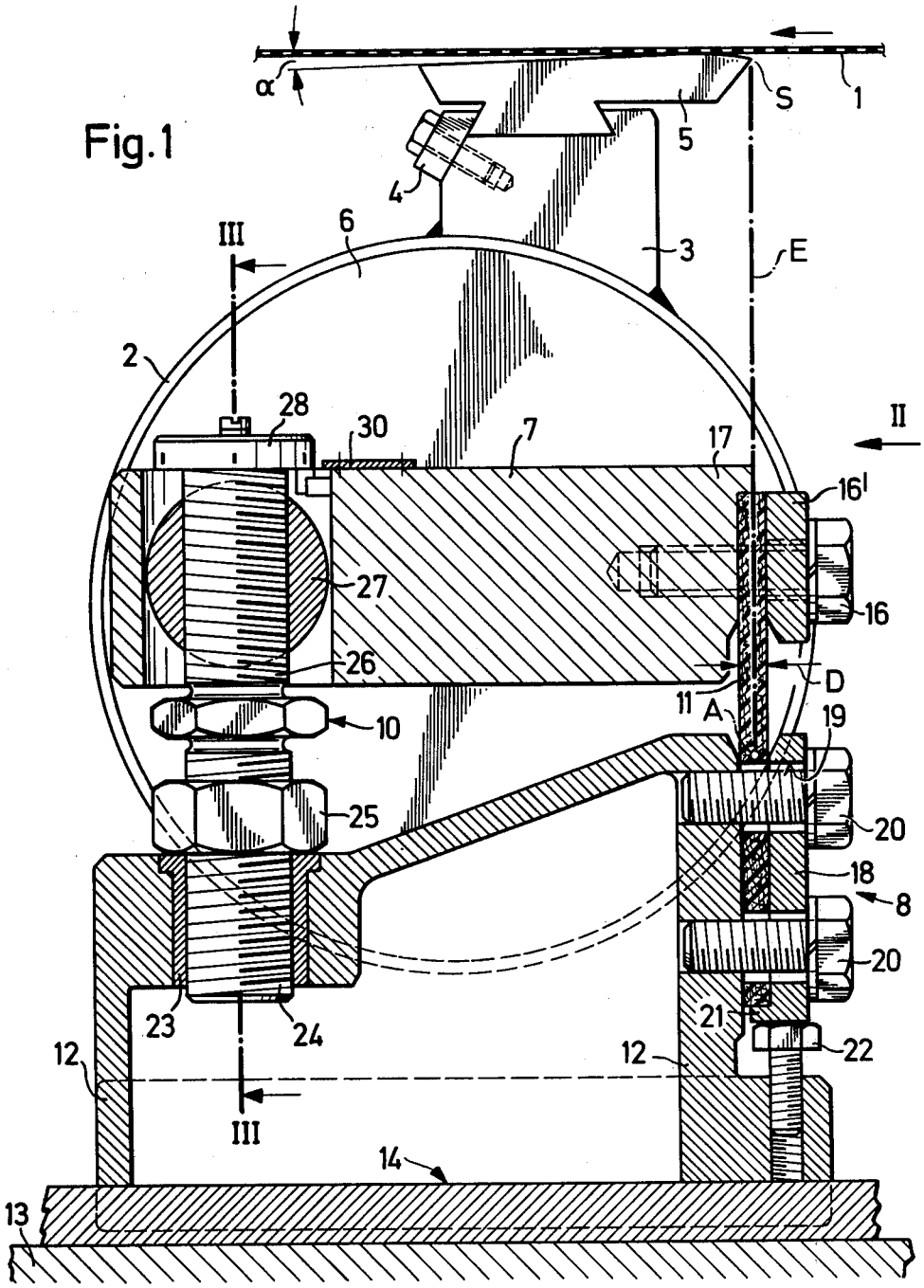
FIG. 1 illustrates an end elevational view of a suction device according to the invention in partial section on line I—I in FIG. 2.

Referring to FIG. 1, the suction device has a tubular carrier 2 which is disposed transversely of a wire 1 of a paper machine (not shown in detail) and on which a suction strip 5 is rigidly fixed by means of a fixing element 3 and a clamping strip 4. Each end of the carrier 2 is closed by a cap 6 which is welded thereon.

The carrier 2 is pivotally supported by a pair of supports 8 (only one of which is shown for simplicity), each located at a respective end of the carrier 2.

Figure 2:
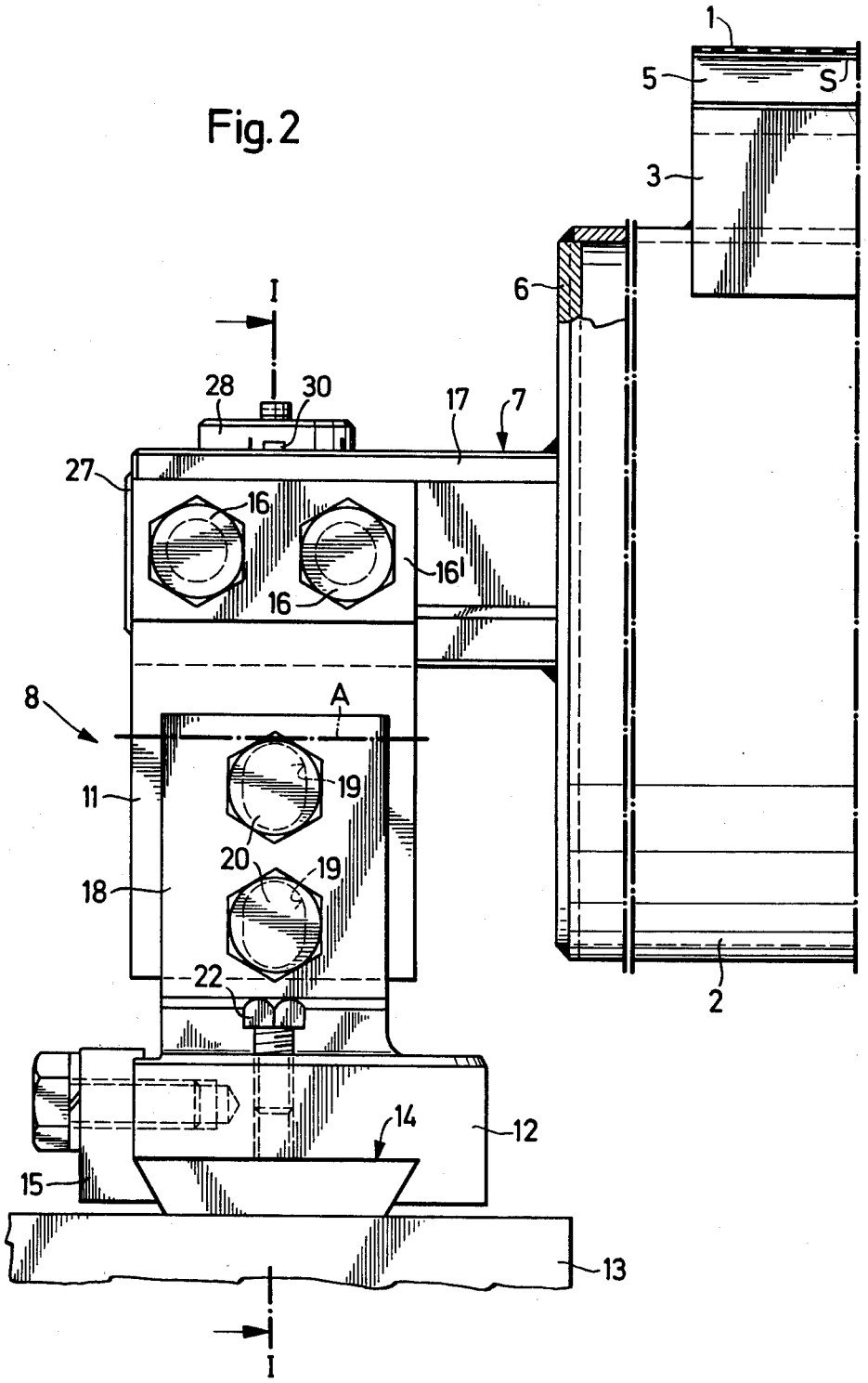
FIG. 2 illustrates a partial side elevation of the device in the direction of the arrow II in FIG. 1.
Figure 3:
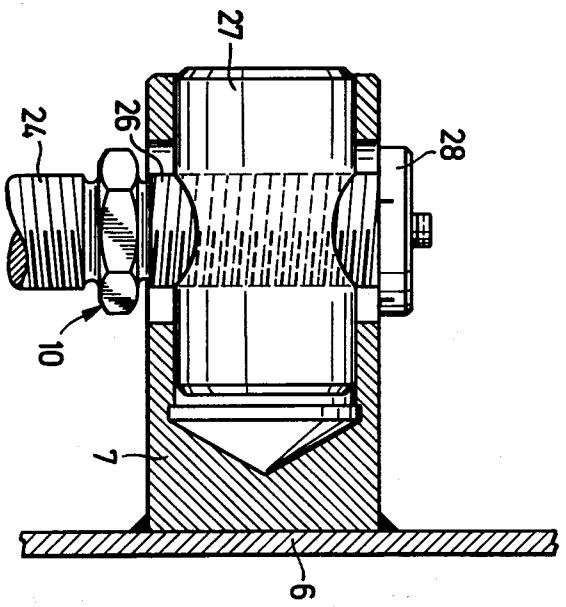
FIG. 3 illustrates a view taken on line III—III of FIG. I.

Each support 8 includes a housing 12 which is adapted for mounting on a frame 13 of the paper machine and, for this purpose, has guides 14 and clamping strips 15. In addition, each support 8 includes a leaf spring 11 which is rigidly fixed to the housing 12 and vertically disposed in a vertical plane E as well as a part 7 which is secured, as by welding, to a cap 6 of the carrier 2. As shown in FIGS. 1 and 2, each part 7 is in the form of a plate which extends substantially parallel to the wire 1 when the suction device is fitted in the paper machine.

The leaf spring 11 is fixed at one end by bolts 16 and a pressure plate 16' to the plate 7 and against a shoulder 17 of the plate 7. The leaf spring 11 is also fixed to the housing 12 by means of a pressure plate 18 and bolts 20. The pressure plate 18 is provided with a shoulder 21 and is supported on a threaded adjusting screw 22 threaded into the housing 12. This screw 22 is located between the housing 12 and leaf spring 11 for adjusting the pressure plate 18 and, thus the leaf spring 11, vertically relative to the housing 12. To this end, the leaf spring 11 and pressure plate 18 have elongated apertures 19 for adjustment.

An adjustment means is provided on at least one end of the carrier 2 for pivoting the carrier 2 about a common axis A extending longitudinally of the carrier 2 and located in the plane E extending through the front tip S of the suction strip 5 perpendicularly of the wire 1. This adjustment means includes an adjustment screw 10 having two screw-threaded portions 24, 26 of different pitches from the other. One portion 24 is screwed into a bush 23 in the housing 12 on an axis parallel to the leaf spring 11. The other portion 26 is screwed into an internal screwthread of a pin 27 which is rotatably mounted in a bore in the plate 7. A lock nut 25 is threadably mounted on the screw 10. The screwthreaded portions 24, 26 have screwthreads with different pitches so that on rotation of the adjusting screw 10 there is a relative movement of the housing 12 and the pin 27 with the associated end of the plate 7. The pitches may differ in respect of their size or in respect of their direction.

As will also be apparent from the drawings (see FIG. 1), a graduated dial 28 is fixed to the top end of the adjusting screw 10 to cooperate with a marker 30 fixed on the plate 7.

During assembly, the leaf spring 11 together with plate 7 and the end of the carrier 2 connected thereto can be accurately adjusted height-wise by means of the screw 22, the required adjustment usually being for equal height at both ends of the carrier 2.

During operation, the pin 27 is lowered or raised with respect to the screwthreaded bush 23 and, hence, the housing 12 by rotation of the screw 10. This results in a rocking movement of the plate 7, which acts as a lever, the leaf spring 11 forming a fulcrum. Rotation of the adjusting screw 10 gives relatively large and also very fine adjustments of the angle $\alpha$ (FIG. 1) of the suction strip 5 with respect to the wire 1, even when the paper machine is in operation.

The pivot axis A about which the rocking movement takes place is situated, as will be seen from FIG. 1, substantially at the transition between the clamped and the freely flexible region of the leaf spring 11. Since, the leaf spring 11 and the axis A are situated in the plane E perpendicular to the wire 1 and passing through the front tip S of the suction strip 5 as considered in the direction of movement of the wire 1, there is practically no change in the height of the strip 5 with respect to the paper machine frame on a rocking movement of the strip 5. Also, the leaf spring 11 is subjected only to compressive stress by forces acting perpendicularly to the suction strip 5 and is thus very rigid. This prevents any vibration of the suction strip.

In the embodiment illustrated, the adjusting screw 10 is also used to support the carrier 2 laterally relative to forces acting parallel to the direction of the wire 1. The screwthreaded portion 24 of the screw 10 is rigidly secured in the bush 23 and can therefore take horizontal forces in FIG. 1, supporting the leaf spring 11 in doing so.

The adjusting screw 10 may preferably be disposed at just one side of the suction device, e.g. the control side of the machine. This is rendered possible by the rigid construction of the carrier in the form of a tube. Adjustment of the angle $\alpha$ is greatly simplified in this way and excludes the risk of damage to the suction strip 5 due to different adjustments at the two ends. The strip 5 preferably consists of a very hard, but brittle material, e.g. aluminium oxide.

If the adjustment by means of the adjusting screw 10 is provided only on one side of the suction device, the screw 10 with the pin 27 and lock nut 28 are simply omitted in the supporting device 8 on the other side.

In the embodiment illustrated, the leaf spring 11 is made from a glass fiber reinforced plastic. In comparison with a metal spring, e.g. of steel, the main advantage is that for the same flexibility the thickness D of the plastic part can be larger than that of a corresponding metal spring. This means increased stiffness relative to forces acting on the suction strip 5 and the carrier 2 in the direction of the wire 1 and, hence, perpendicularly to the plane E.

What is claimed is:

1. A suction device for a paper machine comprising
a suction strip having a suction surface for cooperating with a wire of the paper machine and a front tip;
a carrier having said suction strip rigidly fixed thereon, said carrier being disposed transversely of the wire of the paper machine;
a pair of supports pivotally supporting said carrier about a common pivot axis extending longitudinally of said carrier and located in a plane extending through said front tip of said suction strip perpendicularly of the wire, each support being disposed at a respective end of said carrier and including a housing for mounting on the paper machine, a leaf spring rigidly fixed to said housing and vertically disposed in said plane, and a plate mounted on said carrier and secured to said leaf spring; and
an adjustment means on at least one end of said carrier for pivoting said carrier about said common axis relative to said supports.

2. A suction device as set forth in claim 1 wherein said adjustment means includes an adjustment screw having two screw-threaded portions of different pitches from each other, one of said screw-threaded portions being screwed into said housing on an axis parallel to said leaf spring and a pin rotatably mounted in said plate and having said other of said screw-threaded portions screwed therein.

3. A suction device as set forth in claim 1 which further includes means for vertically adjusting said leaf spring.

4. A suction device as set forth in claim 3 wherein said means for vertically adjusting said leaf spring is an adjusting screw between said housing and said leaf spring for adjusting said leaf spring vertically relative to said housing.

5. A suction device as set forth in claim 1 wherein said leaf spring is made of glass fiber reinforced plastic.

6. A suction device for a paper machine comprising
a suction strip having a suction surface for cooperating with a wire of the paper machine and a front tip;
a tubular carrier having said suction strip rigidly fixed thereon, said carrier being disposed transversely of the wire of the paper machine;
a pair of supports pivotally supporting said carrier about a common pivot axis extending longitudinally of said carrier and located in a plane extending through said front tip of said suction strip perpendicularly of the wire, each support being disposed at a respective end of said carrier and including a housing for mounting on the paper machine, a leaf spring rigidly fixed to said housing and vertically disposed in said plane, and a plate mounted on said carrier and secured to said leaf spring; and an adjustment means on at least one end of said carrier for pivoting said carrier about said common axis relative to said supports.

7. A suction device as set forth in claim 6 wherein said leaf spring is made of glass fiber reinforced plastic.

8. A suction device as set forth in claim 6 wherein said adjustment means includes an adjustment screw having two screw-threaded portions of different pitches from each other, one of said screw-threaded portions being screwed into said housing on an axis parallel to said leaf spring and a pin rotatably mounted in said plate and having said other of said screw-threaded portions screwed therein.

9. A suction device as set forth in claim 6 which further includes means for vertically adjusting said leaf spring.

10. A suction device as set forth in claim 9 wherein said means for vertically adjusting said leaf spring is an adjusting screw between said housing and said leaf spring for adjusting said leaf spring vertically relative to said housing.

11. A suction device as set forth in claim 6 wherein said suction strip consists of a brittle material and said adjustment means is on one end only of said carrier.

* * * * *